US005502940A

United States Patent [19]

Fifield

[11] Patent Number: 5,502,940

[45] Date of Patent: Apr. 2, 1996

[54] COMPOSITE BUILDING ELEMENT AND METHODS OF MAKING AND USING THE SAME

[75] Inventor: John A. Fifield, Aylesbury, Great Britain

[73] Assignee: Oldcastle, Inc., Los Angeles, Calif.

[21] Appl. No.: 108,109

[22] Filed: Aug. 17, 1993

[30] Foreign Application Priority Data

Aug. 21, 1992 [GB] United Kingdom ..... 9217797

[51] Int. Cl.[6] ..... E04D 1/00

[52] U.S. Cl. ..... 52/309.12; 52/309.8; 52/309.11; 52/309.17; 52/560; 52/519; 52/534; 52/536; 52/591.4

[58] Field of Search ..... 52/519, 522, 530, 52/531, 533, 539–541, 560, 591.4, 592.2, 309.8, 309.14, 309.17, 309.12, 302.4, 534, 535, 410, 612, 413, 408, 309.11, 409, 536

[56] References Cited

U.S. PATENT DOCUMENTS

| | | | |
|---|---|---|---|
| D. 27,761 | 10/1897 | Mark . | |
| 147,061 | 2/1874 | Manvel . | |
| D. 282,288 | 1/1986 | Bates . | |
| D. 283,551 | 4/1986 | Repasky . | |
| 479,442 | 7/1892 | Marvick . | |
| 748,141 | 12/1903 | Zwerk | 52/560 |
| 1,796,631 | 3/1931 | Stryker | 52/409 X |

(List continued on next page.)

FOREIGN PATENT DOCUMENTS

| | | | |
|---|---|---|---|
| 0909538 | 9/1972 | Canada | 52/408 |
| 70225 | 3/1992 | Canada . | |
| 0088198 | 4/1982 | European Pat. Off. . | |
| 0088193 | 6/1982 | European Pat. Off. . | |
| 0115374 | 8/1984 | European Pat. Off. . | |
| 0175500 | 3/1986 | European Pat. Off. . | |
| 0236585 | 3/1986 | European Pat. Off. . | |
| WO8906728 | 7/1989 | European Pat. Off. . | |
| 0375802 | 7/1990 | European Pat. Off. . | |
| 1259641 | 3/1961 | France . | |
| 095420 | 11/1983 | France . | |
| 93888 | 12/1896 | Germany . | |
| 9125 | 6/1990 | Ireland . | |
| 1569978 | 11/1975 | Switzerland . | |
| 1020013 | of 0000 | United Kingdom . | |
| Des. 995692 | of 0000 | United Kingdom . | |
| 416649 | 9/1934 | United Kingdom . | |
| 483969 | 10/1937 | United Kingdom . | |
| Des. 896450 | 1/1960 | United Kingdom . | |
| 2046808 | 11/1980 | United Kingdom . | |
| 1586369 | 3/1981 | United Kingdom . | |
| 2111550 | 10/1981 | United Kingdom . | |
| 2123058 | 1/1984 | United Kingdom . | |
| 2178773 | 2/1987 | United Kingdom . | |
| 2245613 | 1/1992 | United Kingdom . | |

OTHER PUBLICATIONS

Monier Roof Tile Brochure re Split Shake.

Hanover Architectural Products, Inc. Brochure re Hanover Pedestal Pavers.

Roofblok, Ltd. Brochure re Roofblock Engineered Ballast Systems.

Brochure entitled "Protect Your Building With Roofcap Paver".

Roofblok, Ltd. Brochure re Roofblok System Design.

Pittsburgh Testing Laboratory Report re Concrete Compressive Strength.

*Primary Examiner*—Robert J. Canfield

[57] ABSTRACT

A composite roofing element comprises a first layer of aggregate based material, a second layer of material having a density less than that of the first layer and has a wedge shaped region depending from its underside. The wedge shaped region is preferably integral with the second layer which can be made of an expanded polymer, expanded polystyrene being particularly suitable. Overlapping structure on the side edges and a recess in the thick end of the wedge enable adjacent elements to interlock with each other. By using such lightweight roofing elements the requirement for a substantial load bearing supporting structure is reduced.

33 Claims, 5 Drawing Sheets

U.S. PATENT DOCUMENTS

| | | | |
|---|---|---|---|
| 2,148,167 | 2/1939 | Lyman | 52/540 X |
| 2,231,006 | 2/1941 | Harshberger | 52/409 X |
| 2,231,008 | 2/1941 | Ochs | 52/536 |
| 2,241,603 | 5/1941 | Kirschbraun | 52/560 |
| 2,510,416 | 1/1947 | Pretty . | |
| 2,573,482 | 10/1951 | Peik | 52/413 X |
| 2,624,298 | 1/1953 | Farren . | |
| 3,095,671 | 7/1963 | Fink et al. | 52/560 X |
| 3,267,823 | 6/1963 | MacRae . | |
| 3,380,215 | 4/1968 | Schaefer et al. | 52/522 |
| 3,440,777 | 4/1969 | Martin | 52/560 X |
| 3,605,369 | 9/1971 | Merrill et al. | 52/560 X |
| 3,873,225 | 3/1975 | Jakobsen et al. . | |
| 4,044,520 | 8/1977 | Barrows | 52/309.12 |
| 4,065,899 | 1/1978 | Kirkhuff . | |
| 4,185,939 | 1/1980 | Barth et al. . | |
| 4,279,106 | 7/1981 | Gleason et al. . | |
| 4,399,643 | 8/1983 | Hafner | 52/530 |
| 4,432,183 | 2/1984 | Pike et al. | 52/533 |
| 4,492,065 | 1/1985 | Clarke, Jr. et al. . | |
| 4,506,483 | 3/1985 | Phalen, Jr. . | |
| 4,535,579 | 8/1985 | Burgoyne et al. . | |
| 4,574,536 | 3/1986 | Bamber et al. . | |
| 4,731,969 | 3/1988 | Baker et al. . | |
| 4,738,068 | 4/1988 | Mendez . | |
| 4,752,520 | 6/1988 | Franklin . | |
| 4,788,808 | 12/1988 | Slocum | 52/560 X |
| 4,899,514 | 2/1990 | Brookhart, Jr. . | |
| 5,060,444 | 10/1991 | Paquette | 52/535 |

COMPOSITE BUILDING ELEMENT AND METHODS OF MAKING AND USING THE SAME

BACKGROUND OF THE INVENTION

1. Field of the Invention

This invention relates generally to composite building elements and, more particularly to composite roofing elements, which are generally lighter in weight than the more traditional non-composite building products.

2. Description of the Prior Art

Traditional roofing elements, such as concrete slabs or roof tiles, whilst being relatively strong are also very heavy. This can be an advantage in terms of wind resistance, but requires the supporting structure on which the elements are mounted to be sufficiently strong or reinforced in order to take the weight safely.

There is therefore a need for a lightweight roofing element which does not require the same strength of support as the traditional products, but which can be securely attached to a supporting structure in a manner which is not easily disturbed by the wind. As well as the relaxation in the required strength of the supporting structure, there are additional benefits in terms of a reduction in transportation costs for taking the products from the point of manufacture to a building site.

SUMMARY OF THE INVENTION

Accordingly, it is an object of the present invention to provide a roofing element which is strong yet light in weight. It is a further object to provide a lightweight roofing element which can be easily affixed by nailing to an underlying support structure without the need for an additional securing means to hold the element in place.

To this end, the present invention resides in a composite roofing element comprising a first layer of aggregate based material and second layer of material having a density less than that of the first layer wherein the roofing element is provided with a wedge shaped region depending from its underside.

The roofing element of the invention is preferably in the form of a block, slab or tile.

In use, the aggregate based layer generally forms the exterior surface of the roofing element. More especially, when installed, it is desireable that only the aggregate based layer is visible from the exterior thereby giving a uniform appearance. In these circumstances, not only should the aggregate based layer entirely cover the surface of the less dense layer which abuts the aggregate based layer, but the edge or edges of element which is or are visible in use should also preferably be covered by the aggregate based layer. More preferably, the bottom edge of the element in use is covered by the aggregate based material. In this way, the external aggregate based layers not only provides the element with a weather resistant finish, but it also gives the appearance of a conventional building product.

The relative thickness of the layers are chosen in accordance with the desired properties of the product. For example, the second layer may be almost as thick as the composite element with the aggregate layer merely comprising a "skin" on the surface of the second layer. In these circumstances the element is generally light in weight but, depending on the material from which the second layer is made, may not have sufficient impact resistance or load bearing capacity to comply with requisite building standards. Alternatively, the layer of aggregate based material may be rather more substantial, thereby ensuring the aggregate layer provides the necessary strength for its intended use.

The surfaces of the first and second layers which are in abutment in the composite roofing element may be planar or may be contoured. Preferably, the surfaces are contoured in such a way as to assist in maintaining the layers in abutment without the need for adhesives or other means of securing the layers together. More preferably, the cooperating surfaces are provided with complementary engaging means to hold the layers in positive engagement with each other, for example, in the form of male and female members. More particularly, the surface of one of the layers may be provided with one or more dovetail ridges and the corresponding surface of the other layer is provided with one or more complementary dovetail channels so that the dovetail channels of the other layer retain the dovetail ridges of the first-mentioned layer.

Advantageously the roofing elements of the invention are rectangular in plan view and profiled so as to overlap with each other both longitudinally and laterally when installed on a supporting structure thereby reducing the penetration of rain, snow and the like between the elements.

To this end, each element is preferably provided with overlapping means, for example in the form of underlocks and overlocks, adjacent each lateral edge to cooperate with the same or similar overlapping means on adjacent elements when in use. As well as discouraging rainwater penetration, the overlapping means may additionally be such as to provide positive engaging means between adjacent elements. This may be achieved, for example, when the upper surface of an underlock extending from one of the lateral edges is provided with a channel and the under surface of an overlock extending from the opposite longitudinal edge may be provided with a ridge. When the elements are laid side by side in use, a channel on one element cooperates with a ridge on an adjacent element.

The roofing elements of the invention are especially appropriate for use on the exterior of buildings, the aggregate based layer providing a weather resistant finish and also giving the appearance of a conventional building product.

The wedge shaped region depending from the underside of the roofing element is preferably integral with the interior layer in use of the composite roofing element, which as described above, is generally the less dense layer. In order to enable the composite roofing elements to overlap with each other, it is preferred that the wedge shaped region does not extend to the edges of the roofing element in all its direction.

More preferably, the wedge shaped region does not extend to the lateral edges of the interior layer thereby forming wings on either side which can overlap with wings on adjacent elements. As previously described, these wings may be in the form of underlocks and overlocks which may also be provided with positive engaging means. In addition, it is preferred that the thick end of the wedge shaped region does not extend as far as the bottom edge of the interior layer thus creating a gap into which can be received the top end of an element in an adjacent row.

The overlap between elements in adjacent rows can be further increased if the thick end of the depending wedge shaped region is recessed, the recess being suitably dimensioned to receive the top edge of a like shaped element. Such an arrangement effectively results in an interlock between elements in adjacent rows. In other words, the fixing of one element has the effect of "trapping" in the recess the top edge of a further element in an adjacent row.

In use, each of the elements is generally laid on a support structure such that the thin end of the wedge points towards the apex of the roof. In the horizontal direction, the elements are laid side by side in a row so that the overlapping means on each longitudinal edge of each element cooperates with overlapping means on an adjacent element. And in the vertical direction, the further rows are laid so that the top edge of the one element is received in the recess at the thick end of the wedge of at least one element in the row above or, in the case of the uppermost row, the top edge of the element lies beneath the edge of a ridge tile.

The wedge shaped roof tiles described above are particularly suitable for use on pitched roofs, especially those whose support structure is in the form of a boarded roof deck. However, the aforementioned elements may also be mounted on a battened roof structure.

From a further aspect therefore, the invention also resides in an inclined roof covering comprising a plurality of roof tiles wherein the upper surface of each tile is substantially planar and the lower surface is provided with a depending wedge shaped region. More especially, each of said tiles is provided with means by which adjacent tiles in the same row can overlap and further means by which tiles in adjacent rows can overlap.

In order to discourage any ingressed water from being retained under the elements and allow for ventilation of the support surface, it is preferred to provide the underside of each element with drainage means. Preferably, the drainage means comprises one or more channels through which water can flow down towards the lowest point of the support surface.

The composite roofing elements of the invention may be affixed to an underlying support structure by any suitable means. Preferably, the elements are affixed simply by nailing. In order to achieve this most effectively, one or more protuberances may be provided on the surface of the less dense layer which abuts the surface of the aggregate based layer.

The effect of the protuberance can either be to reduce the thickness of the aggregate based layer in the region of the protuberance and provide a position where a nail can easily be driven through the layers and into the underlying support structure or, alternatively, when the or each protuberance is the same depth as the aggregate based layer, the upper surface of the protuberance remains visible so that the position through which the nail is to be driven can be easily located. Once installed, however, the upper surface of the protuberance is preferably hidden from view by an overlapping region of an element in an adjacent row.

The size of the roofing elements of the invention may be chosen according to their intended use. For example, when the elements are for roofing purposes, each element may be a similar size to a conventional roofing tile or in the form of a larger panel equivalent to several roof tiles. In the latter case, installation costs can be reduced but the appearance of the roof surface may not be so aesthetically pleasing. This can be easily overcome by featuring the exterior surface of the aggregate based layer to create the impression that each panel consists of several conventional tiles.

In accordance with a further preferred aspect of the invention, the first layer of the composite roofing element generally comprises an aggregate based material, for example, a cementitious material, a polymer bound aggregate or sand, such as polyester bound sand or acrylic bound sand or the like, or any combination thereof. And the second layer which is less dense than the aggregate based layer preferably comprises an expanded polymer, polystyrene and polyurethane being particularly suitable, or other lightweight material such as a lightweight concrete made, for example, from perlite, expanded polystyrene bead or like material.

Third and further layers may be provided, for example a decorative layer may be provided on the upper surface of the aggregate based layer. However, for reasons of ease of manufacture and therefore cost, it is presently preferred to limit the roofing elements of the invention to two or three layers only.

The composite roofing element of the invention can be made by any suitable method, for example, by pre-forming each of the layers and subsequently joining them together to form a composite element. However, it is preferred to pre-form one layer and then form the other layer or layers in situ on the pre-formed layer.

For ease of manufacture, the second layer is preferably pre-formed and the first layer of aggregate based material is then cast on the second layer. The pre-formed layer is advantageously formed by moulding, injection moulding being especially preferred in the case of expanded polymer. When the pre-formed layer is to be shaped for cooperating with adjacent elements and/or contoured for engagements with the aggregate based layer, the mould is preferably of the type in which the two halves of the mould slide open in opposite directions rather than of the type which merely pull apart.

The aggregate based layer may then be cast onto the pre-formed layer for example using block making machinery, wherein the aggregate based layer is applied by loose filling with aggregate based material in an appropriately shaped mould frame containing the pre-formed layer and is then compacted and cured. Compaction is generally achieved by means of vibration together with the application of pressure, for example by using a stripper shoe. After compaction, the mould frame can be moved upwards relative to the static stripper shoe with the result that the composite product is ejected from the mould frame by the stripper shoe. Once ejected, the aggregate based layer of the composite element is allowed to cure to the desired hardness.

In the method outlined above, the pre-formed layer is usually stood on end in the mould frame prior to the addition of the loose aggregate based material. However, care has to be taken to ensure that the compaction process does not damage the pre-formed layer. Damage is liable to occur where the stripper shoe comes into direct contact with a relatively thin edge of a pre-form. If made of polystyrene, the pre-form may often crack or break along the edges where the pressure is applied.

One or more blocks may be used to shield the upper edges of the pre-formed layers in the mould to absorb at least some of the force applied by the stripper shoe thereby relieving the pressure on the edges of the pre-form.

In addition to the above problem, there is also the difficulty of maintaining a pre-form having a depending wedge shaped region in a fixed, upright position while the aggregate based material is introduced into the mould frame and then compacted.

The abovementioned problem can be overcome by arranging the pre-forms in pairs in the mould frame so that each half of a pair supports the other half of the pair in an upright position. Preferably, the pair is arranged in such a manner that the surface of each pre-form on which the aggregate based layer is to be formed is parallel with the sides of the mould frame.

The pre-forms may be maintained in paired relationship in the mould frame by means of supplementary holding means. More preferably, however, the pre-forms are actually manufactured as joined pairs, each half of a pair being attached to the other half in such a way that separation of the pair can be easily achieved after the aggregate based layer has been formed. In the case of pre-forms made from polystyrene, separation can be effected simply by cutting between the two halves or even more advantageously by pulling the two halves apart and allowing the polystyrene to break along a line of weakness created at the join. Smoothing off may be required along the break line but this is not essential.

In order to prevent the paired pre-forms from deviating away from their correct position caused by the pressure exerted on them by the aggregate based material as it is being compacted, it is preferred for one or more blocks to be inserted in any gap created between each pair. Such a block or blocks act to oppose the force caused by the compaction of the aggregate based material and maintain the pre-forms in their desired positions in the mould.

A further manufacturing advantage can be achieved when a block is used to raise the pre-form above the base of the mould. Such an arrangement allows the aggregate based material to be formed additionally on the edge of each pre-form with the result that only the aggregate based material is visible from the exterior when the element is installed.

An alternative method of forming the layer of aggregate based material on a pre-formed layer is to use conventional slab or tile making apparatus, such as an HARDROW (Trade Mark) machine. Such a machine comprises an endless conveyor onto which plates can be laid. Under conventional operating conditions, castable material such as concrete is gravity fed from a hopper onto the plates where the material is then spread and compacted by roller means. The walls of the plates act as dividers between the elements and act to sever at least partially the castable material to form the slabs in the required size.

The machine described above is particularly suitable for applying the aggregate based layer to a first pre-formed layer to form the composite elements of the present invention. The pre-formed layers are laid on the plates and the loose aggregate based material fed from the hopper onto the pre-formed layer where it is then loose compacted by means of one or more rollers.

The plates on which the pre-formed layers are conveyed through the apparatus preferably need to be modified in order that the aggregate layer can be applied onto a horizontal surface and compressed to form an even layer. This is most simply achieved by cutting out a central region of each plate leaving a frame on which to support the perimeter of the pre-formed layer so that the upper surface of it is horizontal and allowing the depending wedge shaped region to hang below the level of the plate.

Final compaction is generally achieved by further conveying the elements to an adjacent region where the elements are compressed under a continuous band, usually of rubber or other elastomeric material, inside which there are a series of weighted, oscillating rollers which provide a compressive force on the elements and also drive the band along its continuous path. The exterior surface of this band, that is, the surface which contacts the surface of the aggregate based layer, may be flat to provide a smooth finish to the composite element or may be featured to provide an irregular finish on the element. In a preferred embodiment, the exterior of the band is featured to provide the composite element with a simulated split-shake finish.

It is also possible using this apparatus to add a further layer on top of the aggregate based layer; this further layer may be such as to provide a decorative surface layer on the element. This further layer may be comprised of any suitable material, for example it could be a curable polymeric material, but more preferably it is an aggregate based material, usually but not essentially different in composition to the first aggregate based layer. When a further layer is included, the conveyor passes under one or more additional rollers to loose compact this further layer before proceeding to the continuous band described above where final compaction takes place.

This latter apparatus is particularly suitable when it is desired to manufacture the elements as large panels. Typically, the elements can be produced in 1 meter widths. If it is desired to create the impression that each panel is made up of smaller elements, the apparatus can be provided with a row of wheels to score the surface of the panel once the panel has emerged from the final compaction region. The wheels are preferably appropriately spaced to score parallel lines along the panels, the space between each lines each representing the width of a smaller element.

BRIEF DESCRIPTION OF THE DRAWING

Embodiments of the invention will now be described, by way of example, with reference to the accompanying drawings in which.

DESCRIPTION OF THE PREFERRED EMBODIMENTS

Figure 1:
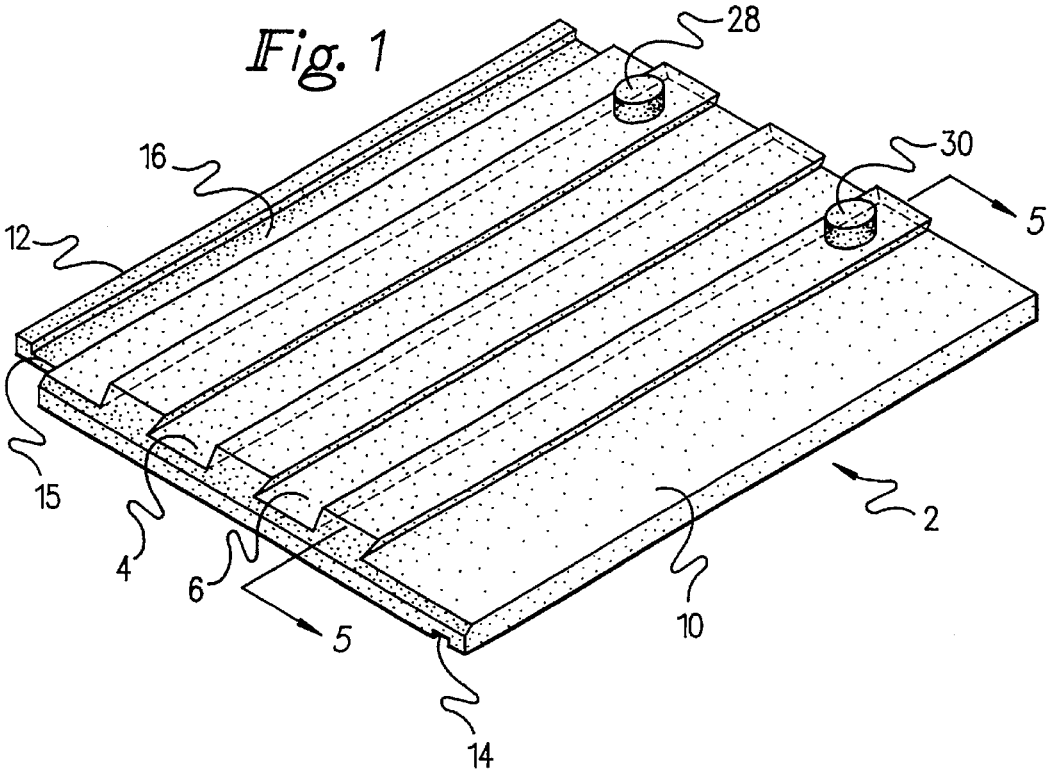
FIG. 1 perspective view from above of a pre-formed layer, according to the invention.
Figure 2:
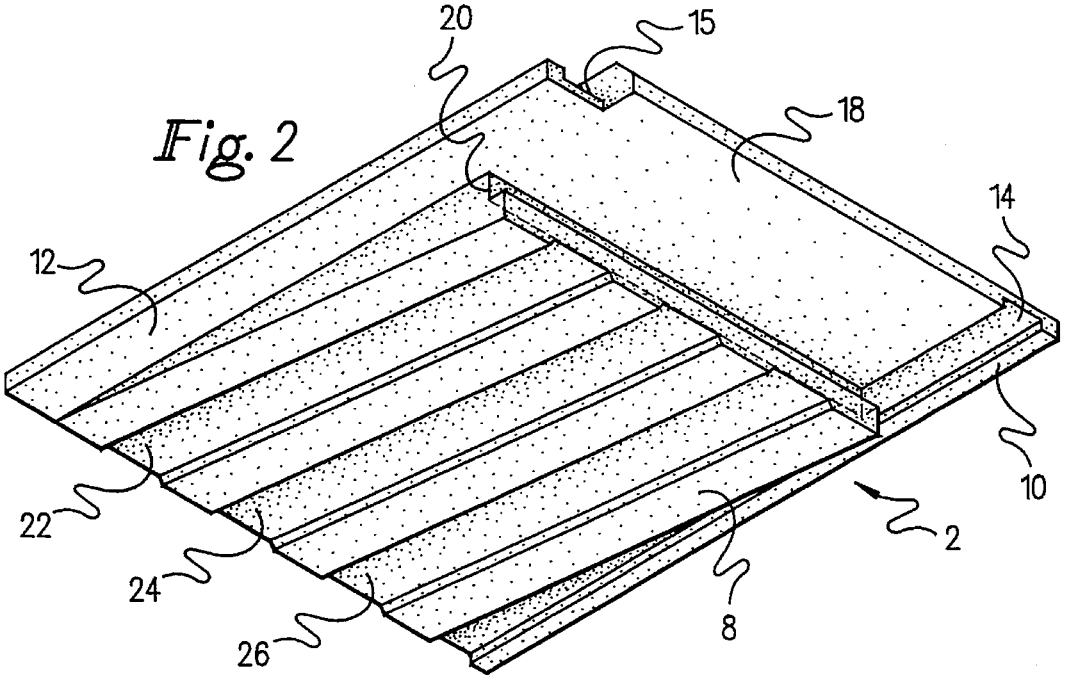
FIG. 2 perspective view from below of the pre-formed layer of FIG. 1.
Figure 3:
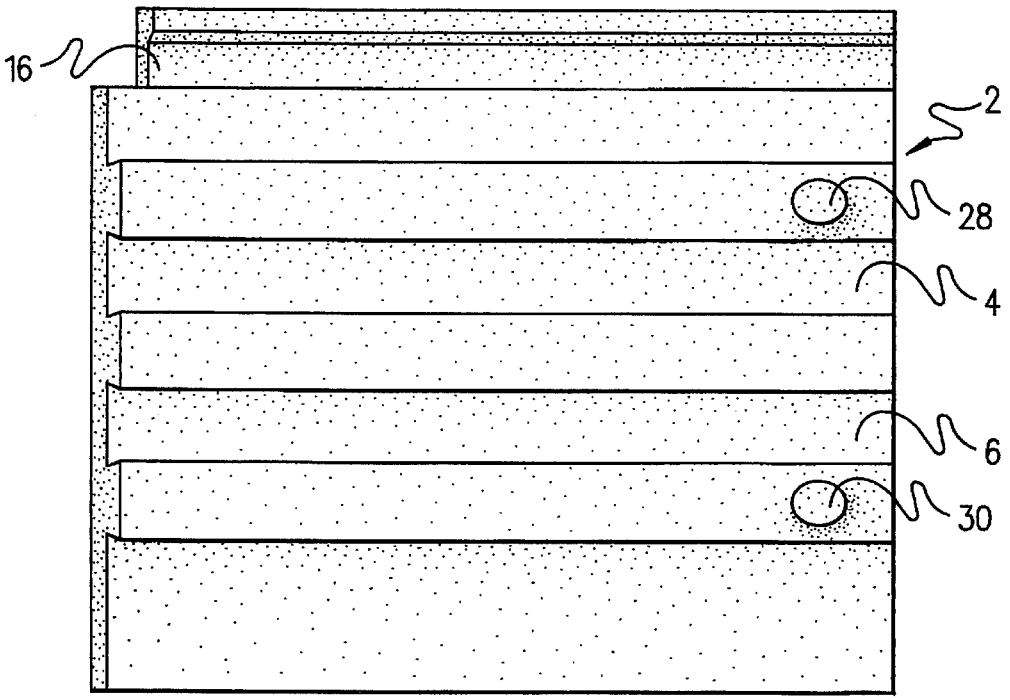
FIG. 3 is a plan view from above the pre-formed layer of FIG. 1.
Figure 4:
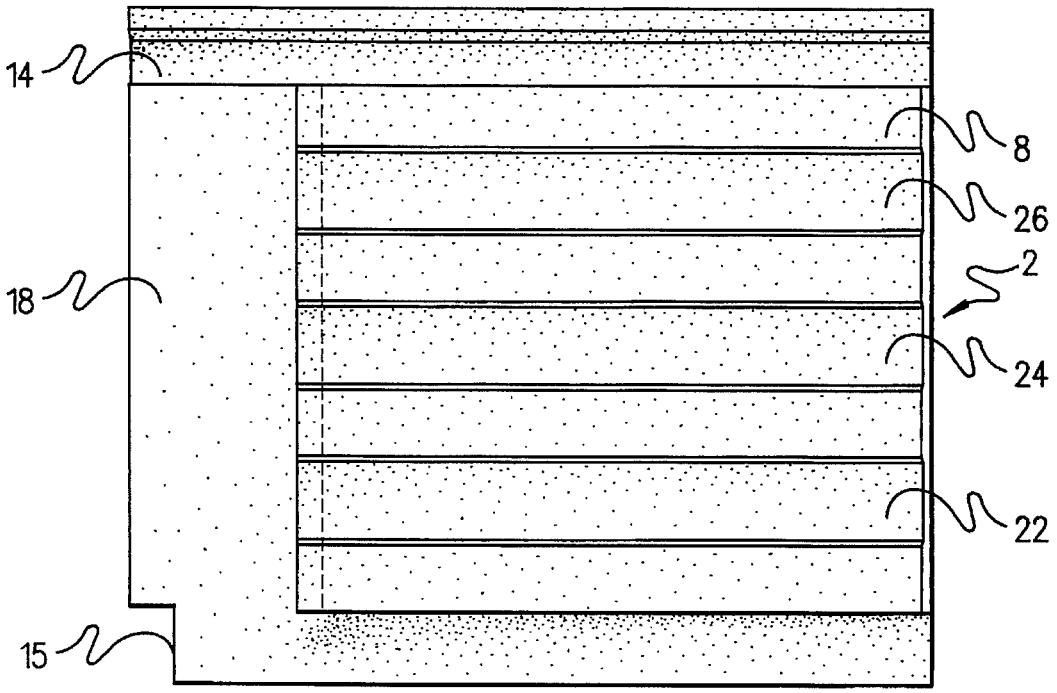
FIG. 4 is a plan view from beneath of the pre-formed layer of FIG. 1.

Referring firstly to FIG. 1 to 4, a pre-formed polystyrene base member 2 formed by moulding is provided with dovetail channels 4, 6 extending longitudinally across the upper surface of the base number 2. Depending from the base member 2, but integral with it, is a generally wedge shaped region 8. The wedge shaped region does not extend across the full area of the base member 2, but falls short in the lateral direction to provide "wings" 10, 12 enabling individual base members to overlap with each other in the lateral direction. These "wings" 10, 12 are provided with an undercut 14 and overcut 16 which cooperate with each other when the base members are assembled thereby providing a means of interengagement between adjacent base members. In the leading edge region of the base member, the overcut 16 ends short of the leading edge to provide a cut-out 15, which enables the undercut to remain out of sight after the layer of aggregate based material has been applied thereby maintaining an aesthetically pleasing appearance once the element has been installed. It can also be seen that the wedge shaped region 8 does not extend fully in the longitudinal direction of each base member, resulting in an open area 18 into which one or more elements from an adjacent row can be received in overlapping relationship. The thick end of the wedge shaped region is moreover provided with a recess 20 into which the leading edge of a composite element can sit.

The underside surface of the wedge shaped region 8 has channels 22, 24, 26 to allow any ingressed rainwater or the like to drain away. The channels 22, 24, 26 also help ventilate the underlying roof deck.

Protuberances 28, 30 are provided on the upper surface of the base member 2. These protuberances 28, 30 provide fixing positions where nails are driven through to attach the elements to the underlying roof surface.

Figure 5:
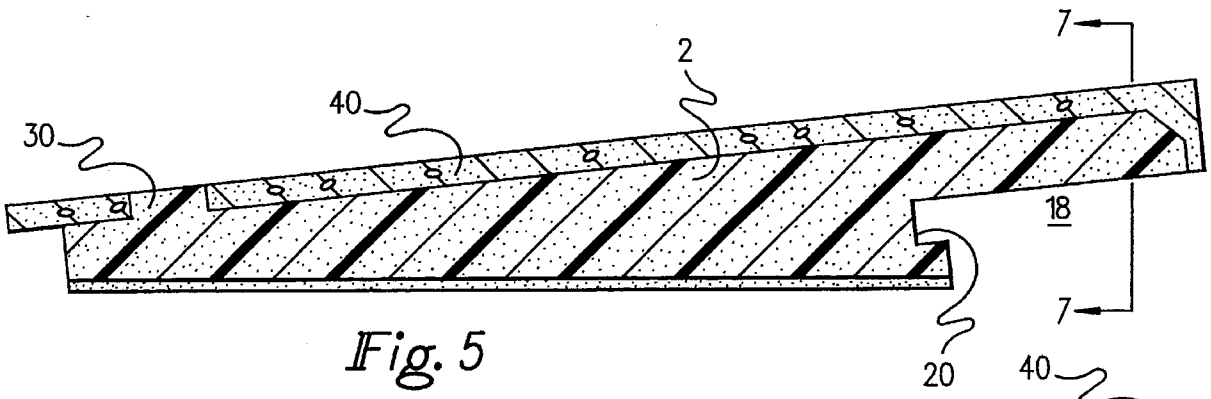
FIG. 5 is a cross-section through the pre-formed layer of FIG. 1 along line 5—5 and to which a layer of concrete has been applied.
Figure 7:
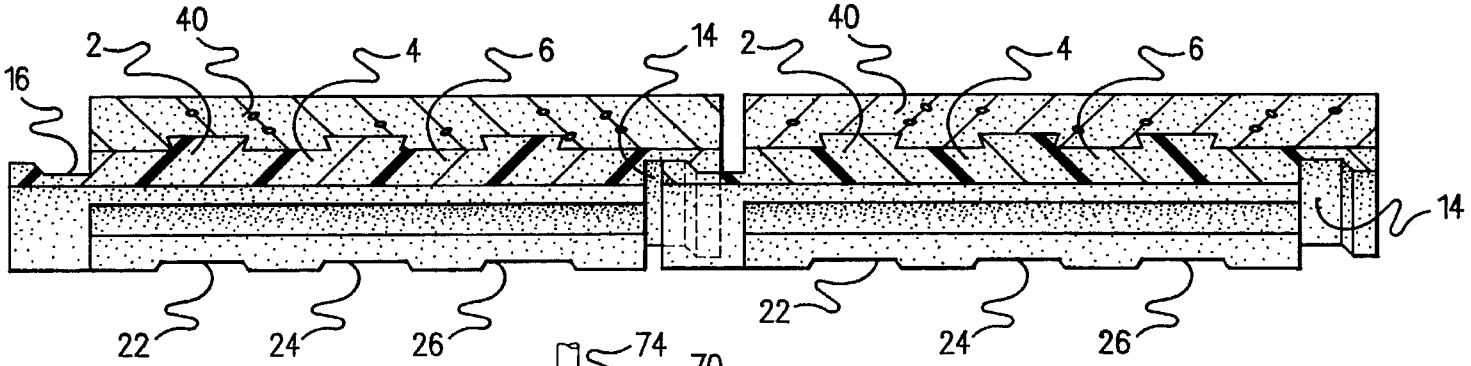
FIG. 7 is a cross-sectional view taken generally through line 7—7 in FIG. 5, but illustrating two adjacent interengaging roofing tiles.

A composite roofing tile according to the invention can be seen in FIG. 5. The pre-formed polystyrene base member 2 shown in the previous drawings is provided on its upper surface with a layer of concrete 40. The concrete layer 40 does not extend into the wing 12 leaving overcut 16 free for interengaging with the undercut 14 of an adjacent roofing tile as shown in FIG. 7.

Concrete fills the dovetail channels 4, 6 of the pre-formed polystyrene base member 2 ensuring that the two layers 2, 40 are secured together without the need for additional adhesive. The depth of the layer of concrete 40 is the same as that of the protuberances 28, 30 so that the latter are just visible on the surface of the composite element. The depth could however be just sufficient to cover the protuberances 28, 30 on the polystyrene base member with the result that the upper surface of the roofing tile has a uniform appearance.

The composite roofing tiles are affixed to the roof support surface 50 by driving nails 52, 54 through the concrete and polystyrene at the position of the protuberance.

Figure 6:
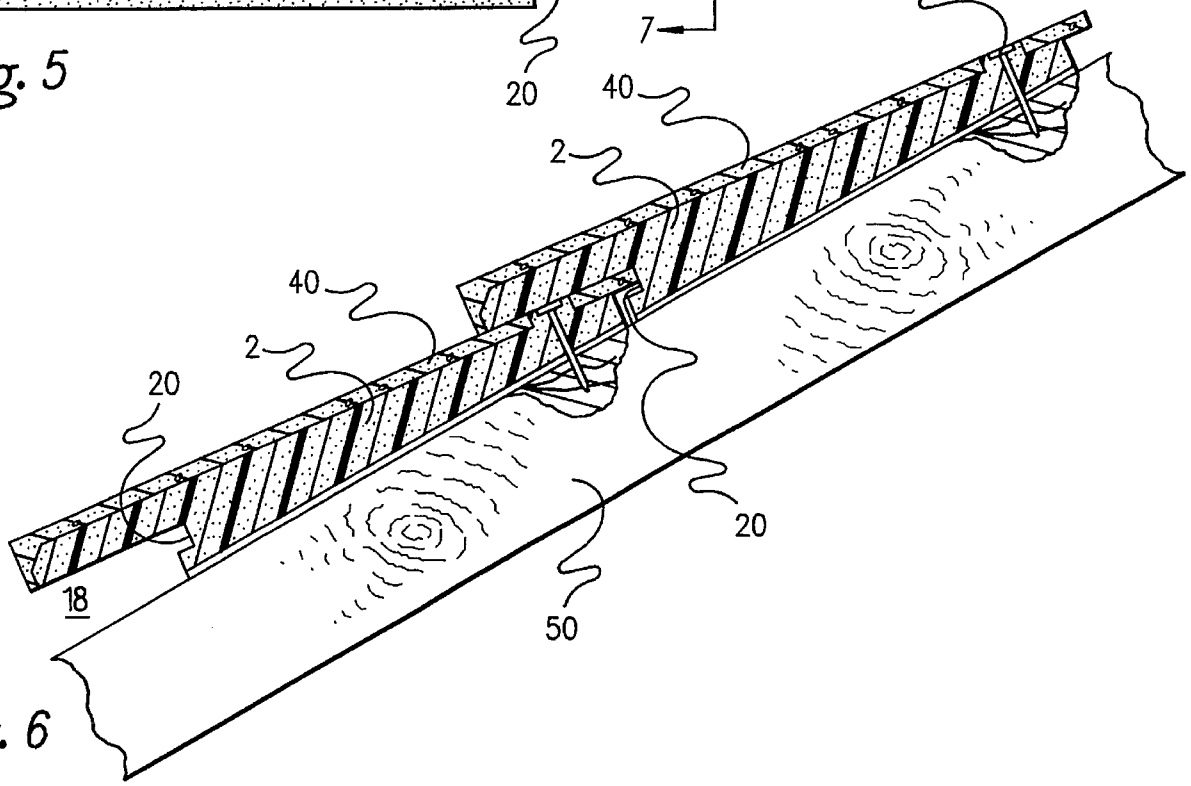
FIG. 6 is a cross-section through a pair of composite roofing tilers in FIG. 5 installed on a timber roof deck.

As can be seen from FIG. 6, adjacent rows of composite roofing tiles overlap in such a way that the leading edge of one tile is received in recess 20 of another. Such overlapping of adjacent rows has the effect of fixing the overlying tile with respect to the underlying tile such that the fixing of one tile also serves to fix the other in a more efficient manner. The overlapping of adjacent rows also hinders penetration by rainwater and the like. However, should the wind be in such a direction as to drive rain between the tiles, the channels 22, 24, 26 permit drainage.

Figure 8:
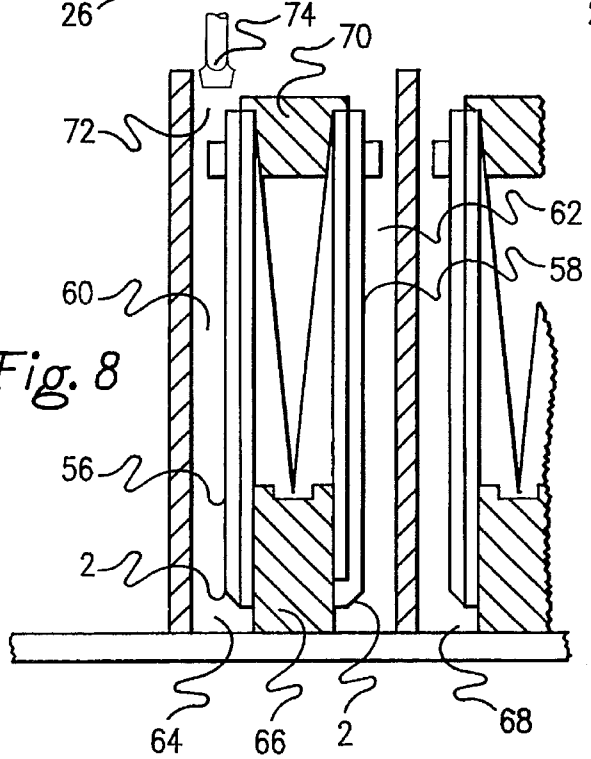
FIG. 8 demostrates one form of apparatus by which a concrete layer is formed on a pre-formed layer.

A concrete layer is applied to the pre-formed polystyrene layer as shown in FIG. 8. A pair of polystyrene base members 2, 2 are joined along the apex of their depending wedge shaped regions in such a manner that the upper surfaces 56, 58 of the base members are upright and substantially parallel with the side walls 60, 62 of a mould frame. Inside the open area created between the pair of base members is positioned a block 66 which serves to raise the members off the plate 68. A further block 70 is wedged between the pair of base members to keep the surfaces 56, 58 parallel.

Concrete 72 is poured into the mould frame between the frame walls and the upper surfaces 56, 58 and is then compacted by means of vibration and compaction via the stripper shoes 74, 76. The pressure applied by the stripper shoes is such that the cavities 64 created by block 66 under the base members are also filled with concrete. Once compacted, the stripper shoes are maintained in contact with the compacted concrete and the mould frame retracted upwards whereby a pair of composite roofing tiles are ejected. Each pair is allowed to cure fully before splitting the pair apart to form the individual tiles.

Figure 9:
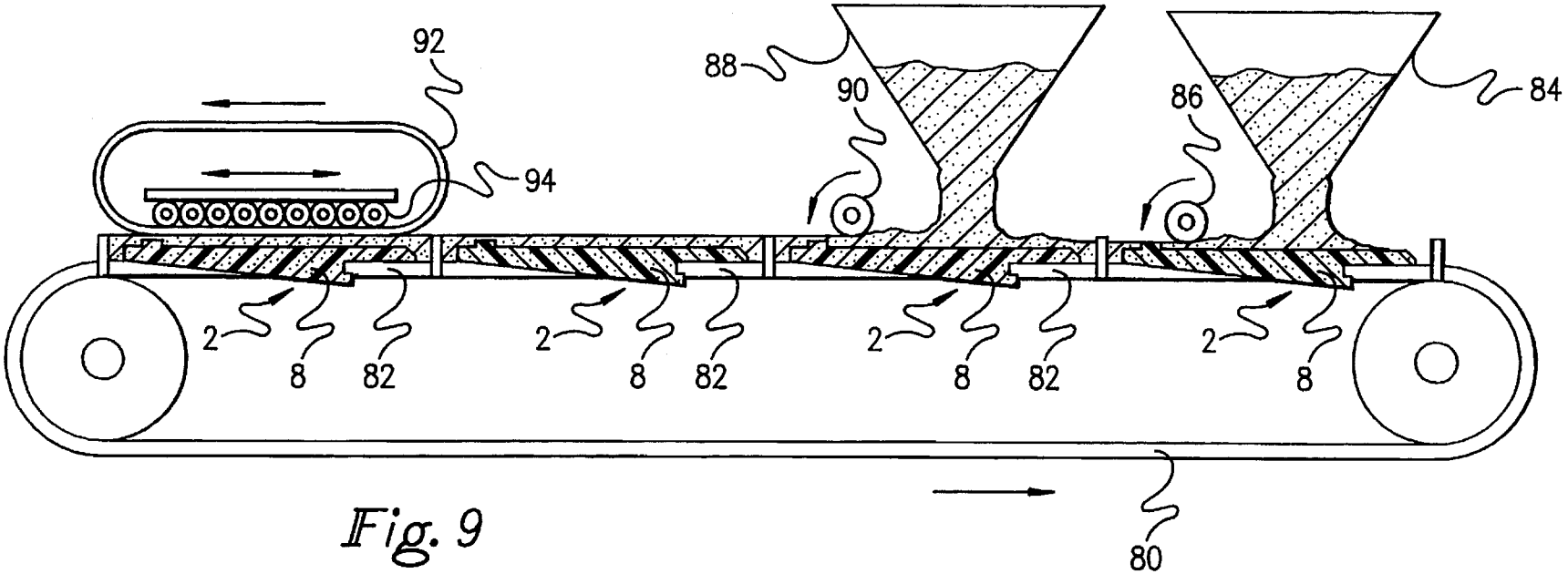
FIG. 9 demonstrates alternative apparatus for casting a concrete layer onto a pre-formed layer.

An alternative method by which a concrete layer is applied to a pre-formed polystyrene base is shown in FIG. 9. The apparatus for carrying out the method comprises an endless conveyor 80 carrying a series of trays 82 on which are placed the pre-formed polystyrene layers 2. Each tray 82 has a cutout or recess in its base to accommodate the depending wedge shaped region 8 of the pre-formed layer and allow the upper surface of the pre-formed layer to be coated to be maintained horizontally.

A concrete mix is fed from the hopper 84 onto the horizontal upper surface of the pre-formed layer and is then conveyed so that it passes under roller 86 which serves to level and loose compact this first layer of concrete. When it is desired to apply a decorative top layer to the first layer of concrete, a further concrete mix is then applied from hopper 88, and this in turn is levelled and loose compacted by means of roller 90.

The trays 82 are further conveyed to pass under a continuous band 92. Band 92 is pressed against the composite element by means of a series of oscillating rollers 94 which are weighted to finally compact the concrete layers. Once compacted, the composite elements are allowed to cure fully on their respective trays.

The present invention may be embodied in other specific forms without departing from the spirit or essential attributes thereof and, accordingly, reference should be made to the appended claims rather than to the foregoing specification as indicating the scope of the invention. For example, the wedge shaped region shown in the accompanying drawings may extend under wing 12 thereby strengthening the element in the overlapping region. Also, the protuberances 28, 30 shown in the drawings may equally be dome shaped.

I claim:

1. A composite roofing element comprising a first layer of aggregate based material having an upper surface which in use forms the exterior surface of said roofing element and a lower surface being in abutment with an upper surface of a second layer, said second layer having a density less than that of said first layer, said element being provided with a wedge shaped region depending from its underside in use, said wedge shaped region being integral with said second layer and wherein said abutting surfaces of said first and second layers include complementary interlocking engaging means comprising one or more male and female members.

2. A composite roofing element according to claim 1 wherein said element is rectangular in plan view.

3. A composite roofing element according to claim 1 wherein said aggregate based material is selected from the group consisting of a cementitious material, a polymer bound aggregate, a polymer bound sand, and any combination thereof.

4. A composite roofing element according to claim 1 wherein said aggregate based material comprises concrete.

5. A composite roofing element according to claim 1 wherein said second layer comprises a polymeric material.

6. A composite roofing element according to claim 5 wherein said polymeric material comprises an expanded polymer.

7. A composite roofing element according to claim 6 wherein said expanded polymer is selected from the group consisting of polystyrene foam and polyurethane foam.

8. A composite roofing element according to claim 1 wherein said second layer comprises a lightweight concrete.

9. A composite roofing element according to claims 8 wherein said lightweight concrete comprises perlite or expanded polystyrene bead.

10. A composite roofing element according to claim 1 in a form selected from the group consisting of a block, slab and tile.

11. A composite roofing element according to claim 11 provided with means for overlapping in use with adjacent elements.

12. A composite roofing element according to claim 11 wherein said overlapping means comprise wings extending along lateral edges of said element.

13. A composite roofing element according to claim 12 wherein said wings comprise an overlock extending from one of said lateral edges of said element and an underlock extending from the opposite lateral edge of said element.

14. A composite roofing element according to claim 11 wherein said overlapping means comprises a recess in a thick end of said wedge shaped region.

15. A composite roofing element according to claim 1 wherein said aggregate based material extends to cover at least one edge of said second layer.

16. A composite roofing element according to claim 15 wherein said aggregate based layer extends to cover all edges of the element which are visible in use.

17. A composite roofing element according to claim 1 wherein said roofing element is provided with one or more apertures adapted to receive a nail for securing said roofing element to a roof structure comprising a resilient protuberance in at least one aperture adapted to receive a nail therethrough.

18. A composite roofing element according to claim 17 wherein each protuberances is provided on the upper surface of said second layer abutting the lower surface of said first layer.

19. A composite roofing element according to claim 17 wherein each protuberances extend at least partially through said first layer.

20. A composite roofing element according to claim 18 wherein the depth of each protuberances is the same as or less than the depth of said first layer.

21. A roofing element according to claim 17 wherein each said protuberance comprises polystyrene.

22. A roofing element according to claim 17 wherein each said resilient protuberance substantially prevents the passage of moisture along a shank of the nail.

23. A composite roofing element according to claim 1 wherein one of said abutting surfaces is provided with one or more dovetail channels and the other of said abutting surfaces is provided with one or more complementary dovetail ridges which fit inside and are retained by said dovetail channels.

24. A composite roofing element according to claim 1 wherein an underside of said element in use is provided with drainage means.

25. A composite roofing element according to claim 24 wherein said drainage means comprises at least one channel.

26. A roof covering for an inclined roof comprising a plurality of roofing elements according to claim 1 wherein in the use the exterior surface of each element is substantially planar and an interior surface is provided with said depending wedge shaped region.

27. A roof covering according to claim 26 wherein each roofing element is provided with means by which adjacent elements in the same row can overlap and further means by which elements in adjacent rows can overlap.

28. A composite roofing element comprising a first layer of aggregate based material and a second layer having a density less than that of said first layer, a surface of said first layer disposed in abutment with a surface of said second layer, said element including a wedge shaped region depending from its underside, and one or more resilient protuberances disposed on said surface of said second layer which abuts said surface of said first layer, said one or more protuberances extending through said first layer.

29. A composite roofing element according to claim 28 wherein the depth of said one or more protuberances is the same as or less than the depth of said first layer.

30. A composite roofing element comprising a first layer of aggregate based material and a second layer having a density less than that of said first layer, a surface of said first layer disposed in abutment with a surface of said second layer, said element including a wedge shaped region depending from its underside, said abutting surfaces of said first and second layers including complementary interlocking engaging means comprising one or more male and female members.

31. A composite roofing element according to claim 30 wherein one of said abutting surfaces is provided with one or more dovetail channels and the other of said abutting surfaces is provided with one or more complementary dovetail ridges which fit inside and are retained by said dovetail channels.

32. In a roofing element possessing a cementitious portion providing with an aperture adapted to receive a nail for securing said roof tile to a roof structure, the improvement comprising:

a resilient protuberance in said aperture adapted to receive a nail therethrough and to substantially prevent passage of moisture along a shank of the nail.

33. A roofing element according to claim 32 wherein said protuberance comprises polystyrene.

* * * * *